US010947809B2

(12) United States Patent
Subbaraman et al.

(10) Patent No.: US 10,947,809 B2
(45) Date of Patent: Mar. 16, 2021

(54) DISSOLVABLE FRAC PLUG

(71) Applicant: GRYPHON OILFIELD SOLUTIONS, LLC, Houston, TX (US)

(72) Inventors: Ganesh Subbaraman, Houston, TX (US); Tyler Roberts, Houston, TX (US); Ian Beckett, Houston, TX (US)

(73) Assignee: GRYPHON OILFIELD SOLUTIONS, LLC, Houston, TX (US)

( * ) Notice: Subject to any disclaimer, the term of this patent is extended or adjusted under 35 U.S.C. 154(b) by 0 days.

(21) Appl. No.: 16/539,711

(22) Filed: Aug. 13, 2019

(65) Prior Publication Data

US 2020/0080396 A1 Mar. 12, 2020

Related U.S. Application Data

(63) Continuation of application No. 16/214,628, filed on Dec. 10, 2018, now Pat. No. 10,422,199.

(60) Provisional application No. 62/728,576, filed on Sep. 7, 2018.

(51) Int. Cl.
*E21B 33/12* (2006.01)
*E21B 34/06* (2006.01)

(52) U.S. Cl.
CPC ..... *E21B 33/1208* (2013.01); *E21B 34/063* (2013.01)

(58) Field of Classification Search
None
See application file for complete search history.

(56) References Cited

U.S. PATENT DOCUMENTS

| | | | | |
|---|---|---|---|---|
| 1,963,072 | A | 6/1934 | Boundy | |
| 3,164,206 | A | 1/1965 | Sharp | |
| 5,479,986 | A | 1/1996 | Gano et al. | |
| 5,607,017 | A | 3/1997 | Owens et al. | |
| 7,168,494 | B2 | 1/2007 | Starr et al. | |
| 8,276,670 | B2 | 10/2012 | Patel | |
| 8,528,633 | B2 | 9/2013 | Agarwal et al. | |
| 8,567,494 | B2 | 10/2013 | Rytlewski et al. | |
| 10,167,691 | B2 | 1/2019 | Zang et al. | |
| 2007/0107908 | A1 | 5/2007 | Vaidya et al. | |
| 2010/0270031 | A1 | 10/2010 | Patel | |
| 2012/0276356 | A1 | 11/2012 | Xu et al. | |
| 2013/0020088 | A1* | 1/2013 | Dyer | E21B 34/063 166/373 |
| 2013/0160992 | A1 | 6/2013 | Agarwal et al. | |
| 2013/0340599 | A1 | 12/2013 | Parrott et al. | |
| 2015/0285026 | A1 | 10/2015 | Frazier | |
| 2015/0354310 | A1 | 12/2015 | Zaiser | |
| 2016/0047198 | A1 | 2/2016 | Hardesty et al. | |
| 2017/0204697 | A1 | 7/2017 | Fripp et al. | |
| 2017/0234103 | A1 | 8/2017 | Frazier | |
| 2018/0119508 | A1 | 5/2018 | Wise et al. | |

* cited by examiner

*Primary Examiner* — Shane Bomar
(74) *Attorney, Agent, or Firm* — Winston & Strawn LLP

(57) ABSTRACT

A dissolvable frac plug is disclosed. The dissolvable frac plug has an internal chamber surrounded by an external wall with the chamber containing a dry powder component in an amount sufficient to combine with ground water or other wellbore fluids to form a solution or environment that enhances dissolution of the plug. The dry powder is released from the chamber as a portion or portions of the external wall dissolves due to contact with water or other wellbore fluids.

19 Claims, 6 Drawing Sheets

DISSOLVABLE FRAC PLUG

CROSS-REFERENCE TO RELATED APPLICATIONS

This application is a continuation of U.S. application Ser. No. 16/214,628 filed Dec. 10, 2018, which claims the benefit of U.S. application 62/728,576 filed Sep. 7, 2018, the entire content of which is expressly incorporated herein by reference thereto.

BACKGROUND

The present invention relates to a dissolvable frac plug that can be dissolved more rapidly when the plug is to be removed from the wellbore.

Downhole plugs are used in the extraction industry to seal off portions of wellbores for a variety of reasons. Portions of a wellbore may be sealed off to assist in the collection of hydrocarbons, to create pressure, or isolate zones of the well, for example. After the operation involving the downhole plug is complete, the plug must be removed from the wellbore or otherwise disposed of. Various means of disposing of downhole plugs have been practiced over the years. Traditionally, such plugs were degraded or destroyed with mechanical means such as drilling or milling. But such operations can be complex, time-consuming, and expensive.

Dissolvable downhole plugs have been proposed to remedy the disadvantages of traditional plugs and facilitate plug retrieval or disposal. Typically, dissolvable plugs are made in part or whole of material that dissolves the plugs when they come into contact with certain elements such as water or other downhole fluids. After the plug is sufficiently dissolved, its remnants may be more easily retrieved for disposal. Dissolvable frac plugs are typically constructed with dissolvable alloys such as magnesium or aluminum, or polymers such as Polylactide/polyglycolide copolymers PGA, PLA or PLGA. These materials often require high temperatures as well as contacts with fluids having high salinity, high acidity, or other corrosive properties, to dissolve. However, high temperature, salinity, or acidity conditions may not be available at certain drilling sites. For example, in Permian basin wells, the lower temperature and salinity of the well fluids decreases their reactivity with dissolvable frac plugs and significantly increases the dissolution time. In such cases, a frag plug may not be sufficiently dissolved for removal after the frac procedure, requiring additional mechanical operations such as drilling or milling.

There is therefore a need for a dissolvable frac plug that can dissolve in insufficient or adverse downhole conditions. In particular, there is a need for a dissolvable frac plug that can enhance the corrosive properties of the downhole conditions where the frac plug is deployed. There is a further need for a dissolvable plug that can accelerate the dissolution process at the completion of frac plug operations.

SUMMARY OF THE INVENTION

According to embodiments of the present invention, a dissolvable frac plug is disclosed. An improvement to existing dissolvable frac plugs includes providing one or a plurality of internal chambers surrounded by an external wall with at least one chamber containing a dry powder component in an amount sufficient to combine with other chemical compounds, water or other wellbore fluids to form a solution or environment that enhances dissolution of the plug. This allows the dry powder and if present the other chemical compounds to be released from the chamber(s) as a portion or portions of the external wall dissolve due to contact with water or other wellbore fluids so that additional portions of the external wall dissolve more rapidly due to contact with the solution or environment compared to contact with water or other wellbore fluids.

Preferably, plural internal chambers are provided, at least one, some or all of which contains the dry powder. Alternatively, one or some of the chambers contain the dry powder and one or some of the chambers contain one or more different chemical components that combine with the powder to create the solution or environment.

In some embodiments, the internal chamber includes one or more cylindrical chambers that surround the dissolvable frac plug. These can be arranged in a variety of configurations with the size of chambers varying depending upon the size of the plug and the speed of dissolution desired, as well as to accommodate the dry powder and if necessary one or more additional chemical components that will combine with the dry powder.

In certain desirable embodiments, the external wall includes one or more openings to allow filling or packing of the internal chamber with the dry powder or other components. In some of these embodiments, the one or more openings are closed by a curable compound that seals the internal chamber(s) and prevents escape of the dry powder or other components.

In a preferred embodiment, the dry powder is sodium bisulfate or aluminum chloride or both and the external wall is made of a dissolvable aluminum or magnesium metal or alloy. Typically, the dry powder is present in an amount that provides a volume ratio of between about 1.25:1 to 6:1 and preferably 3:1 with respect to the external wall volume. Generally, the external wall is configured to dissolve in water or other wellbore fluids within eight and twelve hours, and then the dry powder is released to more rapidly dissolve a sufficient portion of the remaining plug to facilitate removal or retrieval of remaining portions of the plug. The different dry powder materials can be provided in the same chamber or in different, adjacent chambers. Placing different dry powders in different chambers is necessary when the dry powders are reactive with each other. In that situation, they can react after being released to create a more corrosive environment that causes dissolution of the plug.

An additional embodiment of the present invention includes a method of enhancing dissolution of a dissolvable frac plug. The method comprises providing a dissolvable frac plug as disclosed herein with chemical components, water or other wellbore fluids to form a solution or environment that enhances dissolution of the plug, delivering the dissolvable frac plug into a wellbore wherein water or other wellbore fluids are present downstream of the plug, initially dissolving the dissolvable frac plug by contact with the water or other wellbore fluids over a certain period of time to at least dissolve a portion or portions of the external wall and expose at least a portion of one or some of the internal chambers, and releasing the dry powder and if desired other chemical components from the internal chamber into the water or other wellbore fluids to form the solution or environment that enhances the dissolution of the dissolvable frac plug.

BRIEF DESCRIPTION OF THE DRAWINGS

Various features of examples and embodiments in accordance with the principles described herein may be more readily understood with reference to the following detailed description taken in conjunction with the accompanying drawings, where like reference numerals designate like structural elements, and in which.

DETAILED DESCRIPTION OF THE INVENTION

The present system and method will be described in connection with the figures, it being understood that the description and figures are for illustrative, non-limiting purposes.

Embodiments of the present invention disclose a dissolvable downhole tool in particular as a frac plug. The dissolvable downhole tool comprises an internal chamber containing a compound formulated to accelerate the dissolution of the downhole tool when mixed with certain downhole fluids. The compound is released in the downhole environment after an external wall of the internal chamber is dissolved from prolonged contact with the downhole fluids.

Figure 1A:
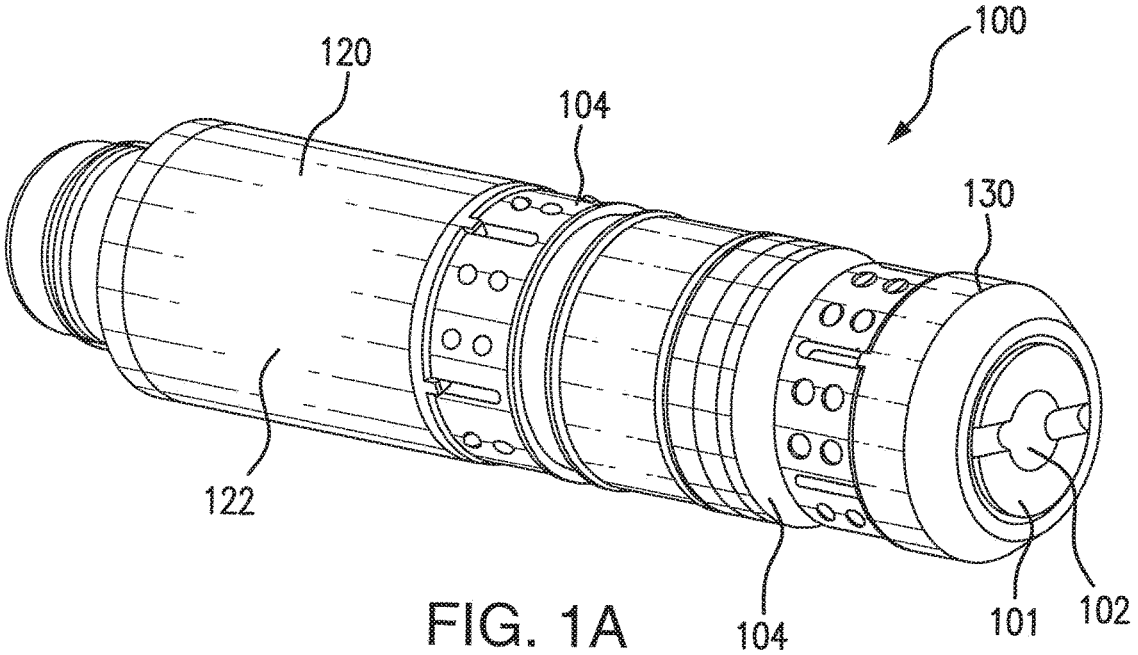
FIG. 1A illustrates a perspective view of a dissolvable frac plug comprising an internal chamber near or at the upper portion of the plug, according to an embodiment consistent with the principles described herein.
Figure 1B:
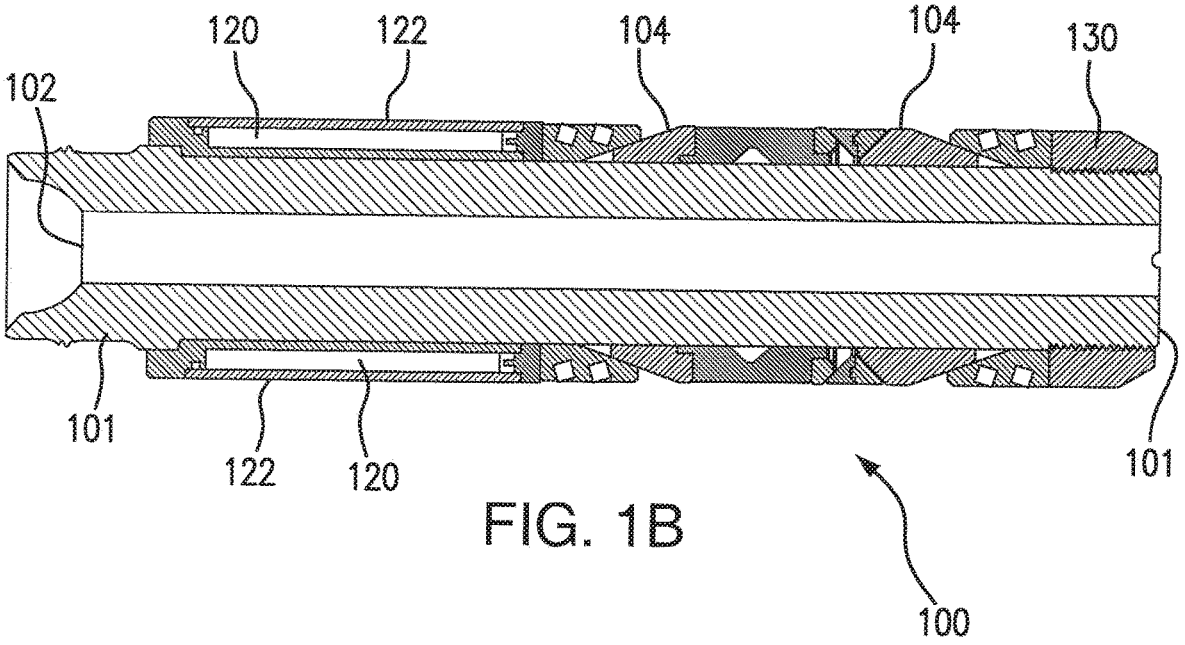
FIG. 1B illustrates a cross-sectional view of a dissolvable frac plug comprising an internal chamber near or at the upper portion of the plug, according to an embodiment of the principles described herein.

FIG. 1A illustrates a perspective view of a dissolvable frac plug 100, according to an embodiment consistent with the principles described herein. FIG. 1B illustrates a cross-sectional view of a dissolvable frac plug 100, according to an embodiment consistent with the principles described herein. The dissolvable frac plug 100 has a generally tubular elongated shape suitable for deployment into a wellbore. The dissolvable frac plug 100 may comprise various sections depending on its type and construction. For example, in the embodiment illustrated in FIGS. 1A and 1B, the dissolvable frac plug 100 comprises a hollow mandrel core 101 that runs the length of the tool. The mandrel core 101 has an axial flowbore 102 running therethrough. Portions of the mandrel 101 are encased by various radial structures 104 including for example, push ring assemblies, slider ring, upper and lower sup assemblies, and upper and lower cones. In the bottom portion of the dissolvable plug 100, the bottom portion of the mandrel core 101 may be partially enclosed by a concentric structure called a bottom cap 130. In the embodiment of FIGS. 1A and 1B, the bottom cap 130 is threaded for fastening to the bottom portion of the mandrel core 101. In some embodiments, the radial structures 104 are integrally formed with the mandrel core 101. In other embodiments, the radial structure 104 may be secured to the mandrel core 101 using various fastening means.

The dissolvable frac plug 100 may be constructed with a variety of materials. In some embodiments, the dissolvable frac plug may comprise material selected or designed for withstanding downhole conditions. Such material may include insoluble metals or alloys including titanium, copper, iron, and combinations thereof. Suitable metals and alloys may also be blended to other material to impart desirable properties to relevant parts of the dissolvable frac plug 100, such as increased strength or resistance to a certain downhole conditions.

Further, at least part of the dissolvable frac plug 100 is fabricated with material that can dissolve under certain conditions. Such materials may lose structural integrity, disintegrate, and even become soluble over time as they come in contact with or are immersed in other materials or compounds. In particular, the dissolvable frac plug 100, or portion of the dissolvable frac plug 100, may be built with material that reacts with and is degraded by exposure to downhole fluids such as water, brine, injection fluids, production fluids, drilling fluids, or various combinations thereof.

The dissolvable frac plug 100 further comprises an internal chamber 120. In the embodiment illustrated in FIGS. 1A and 1B, the internal chamber 120 of the dissolvable frac plug 100 is a concentric radial enclosure that surrounds a portion of the length of the mandrel core 101. In this embodiment, the internal chamber 120 is located near an upper end of the dissolvable frac plug 100, and extends down to between a third and a half of the length of the dissolvable frac plug 100. In other embodiments, the internal chamber 120 may be formed in a different location of the dissolvable frac plug 120. Further, the internal chamber 120 may have any of a variety of shapes. For example, the internal chamber 120 may have a rectangular or box shape. The internal chamber 120 may also have a cylindrical shape or even a spherical shape, in some embodiments. Preferably, at least one wall of the internal chamber is an external wall 122 of the dissolvable frag plug 100 that is exposed to the downhole environment, including the downhole fluids mentioned herein. In some embodiments, the external wall 122 of the internal chamber 120 is made of a dissolvable material that may react with said downhole fluids. The external wall 122 may thus be a component of the dissolvable portion of the dissolvable frac plug 100.

The internal chamber 120 serves to house a compound that is caustic or corrosive to at least a dissolvable portion of the dissolvable frac plug 100. Herein, the terms "caustic" or "corrosive' as applied to the compound refer to a compound that is able to cause, promote, enhance, or accelerate the dissolution of another substance, whether alone or in combination with other compounds. Thus, the internal chamber 120 is configured to contain a corrosive compound capable of causing or accelerating the disintegration of at least a part of the dissolvable frac plug 100. The corrosive compound may come in any of a variety of forms. The compound may be a solid, liquid, or a gas, or any combination thereof, in various embodiments. Further, the corrosive compound may be able to react with a reactive portion of the dissolvable frac plug 100 by itself. This of course requires the design of the chamber 120 holding the corrosive material to have a sufficient thickness to retain the necessary strength for a period of time to allow wellbore operations to take place (e.g., 8-12 hours) before the plug 100 dissolves sufficiently to facilitate removal. In addition, the design of the internal chamber 120 and in particular, the thickness of the external wall 122 may reflect the possibility that the dissolvable frac plug 100 is immersed in enough water to start the dissolution of the external wall 122, as is the case in a typical wellbore.

Preferably, the corrosive compound is one that requires the addition of a different compound to gain the capability to rapidly degrade or increase the dissolution of the dissolvable frac plug 100. This can be achieved by providing different compounds in adjacent chambers such that the initial dissolution of the external wall 122 causes the compounds to be released where they can mix to form greater corrosivity and faster dissolution of the plug. For example, in some embodiments, one chamber may contain sodium bisulfate while another contains aluminum chloride, the mix of which may be more corrosive than each alone. Alternatively, the existing corrosive properties of a compound can be enhanced when the compound is combined with surrounding wellbore fluids. For example, a salt compound when released from the internal chamber combines with groundwater to form a solution that is much more corrosive than the salt itself. Further, multiple different compounds in different chambers (e.g., the sodium bisulfate, aluminum chloride, and others) may mix together with the downhole fluids to form more potent corrosive solutions to dissolve the plug 100 at a faster rate.

During operation of the dissolvable frac plug 100 in the wellbore, external surfaces of the dissolvable frac plug 100, and in particular, the dissolvable external wall 122 of the internal chamber 120, are exposed to downhole fluids such as water, brine, or injection fluids. The fluids may thus begin to degrade the external wall 122 during the operation of the dissolvable frac plug 100 at a relatively slow rate. In environments such as the Permian basin where downhole conditions may not be sufficiently corrosive, the dissolution of the dissolvable portions of the frag plug 100 may be minimal while the plug is deployed and operational. However, a size, thickness, composition, or other characteristic of the external wall 122 may be designed to time the degradation of the external wall 122 by the downhole fluids with the duration of deployment of the dissolvable plug 100. For example, the external wall may be sized to not be breached until after 8-12 hours to allow time for conventional fracking operations to be conducted. Accordingly, after operations involving the dissolvable frac plug 100 are completed, the downhole fluids breach the external wall 122 and cause the corrosive compound contained in the internal chamber 120 to and mix with the downhole fluids to form a new solution. The resulting mix of corrosive compound and downhole fluids exhibits corrosive properties that are significantly superior to that of the downhole fluids alone. As a result, the dissolution of the dissolvable frac plug 100 after the beach of the internal chamber 120 is accelerated by several hours. Further, the enhanced dissolution facilitates the removal of the dissolved frac plug from the wellbore.

The dissolvable frac plug 100 is sized to perform its various functions, such as isolating zones of the wellbore. Accordingly, an external diameter of the dissolvable plug 100 may be comparable to a diameter of a wellbore, for example. Further, a size of the dissolvable frac plug 100 may be a factor in the plug's dissolution time. For example, a smaller dissolvable frac plug 100 may dissolve faster than a larger plug for the same concentration of corrosive solution. The size of the dissolvable frac plug 100 may also affect the quantity of corrosive compound carried in the internal chamber 120, which in turn affects the dissolution time of the plug 100. In light of these and other relevant factors, an exemplary dissolvable frac plug 100 may weight about 10 lbs, and have a length of about 13.82 inches, with an internal diameter for the mandrel core 101 of about 2 inches, and an external diameter for the plug of about 4.25 inches, in some embodiments. It should be noted that other dimensions for the dissolvable frac plug 100 are possible depending on properties of the plug (e.g., dissolution time, weight, etc.) are balanced or prioritized in its design.

Various combinations of the dissolvable material of the frac plug 100 and the corrosive compound may be used. For example, a dissolvable portion of a frag plug 100 may be composed of a material that is degradable when exposed to a high basicity (or high pH) compound. In some embodiments, the dissolvable frag plug material may be reactive with a high acidity (low pH) compound. In other embodiments, a property of the dissolvable frac plug material and the corrosive compound other than the pH scale may precipitate their reaction and cause the dissolution a portion of the frac plug 100. In embodiments where the dissolvable frac plug 100 or portion of the frac plug 100 is made of a magnesium or aluminum alloy, the corrosive compound may comprise a compound that forms an acidic solution when mixed with downhole fluids. The use of a compound that becomes corrosive only when mixed with downhole fluids alleviates the need to protect the internal chamber 120 from reacting with the compound (for example, with an internal coating), in order to guard against a premature dissolution from inside the internal chamber 120.

In a preferred embodiment, the corrosive compound comprises sodium bisulfate, also known sodium hydrogen bisulfate or sodium acid sulfate $NaHSO_4$). Sodium bisulfate is an acidic salt often used to create acidic solutions when mixed with one or more solvents such as water. The acidic salt comes in the form of a powder or similar granular structure. However, other suitable compounds have may different structures, such as one or more solid blocks of material that may dissolve upon contact with downhole fluids. The resulting acidic solution degrades the magnesium or aluminum alloys of the dissolvable plug 100 at a faster rate than water alone or any of the low acidity downhole fluids circulating in the wellbore. Various quantities of sodium sulfate may be suitable depending on the size of the frac plug 100, the downhole conditions, and other operational factors. For example, at a site where the downhole fluids have a relative elevated salinity, acidity, and/or temperature, a smaller quantity of sodium bisulfate may be sufficient to enhance the dissolution of the frac plug 100. In some embodiments, the amount of sodium bisulfate to be used is preferably about three times the volume of the dissolvable portion of the frac plug. This ratio may provide an optimum rate and degree of dissolution, in some examples.

Aluminum chloride ($AlCl_3$) may also serve as a corrosive compound for the dissolvable plug 100, in some embodiments. As with sodium bisulfate, aluminum chloride can be packed inside the internal chamber 120 as a solid or granular compound or a powder that can form an acidic solution when mixed with downhole fluids to degrade the dissolvable plug 100. This can be mixed with the sodium bisulfate or provided in a different adjacent chamber. If desired, multiple chambers of each powder or even multiple chambers of different powders can be used. And as wellbores are typically flush with ground water, the release of the powder or powders creates an acidic, corrosive environment that more rapidly dissolves the plug than water alone.

Figure 2A:
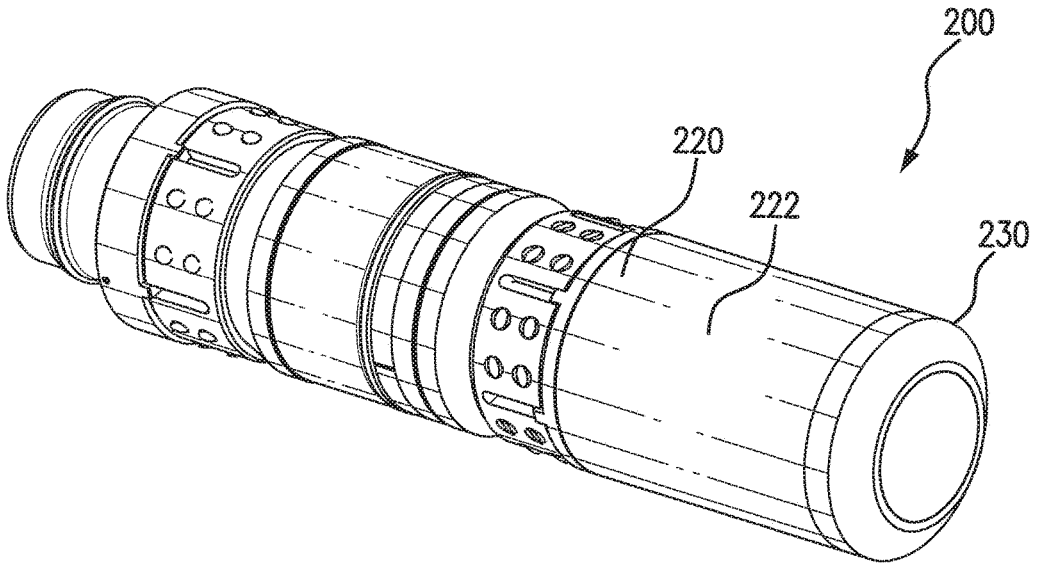
FIG. 2A illustrates a perspective view of a dissolvable frac plug comprising an internal chamber near or at the bottom portion of the plug, according to an embodiment consistent with the principles described herein.
Figure 2B:
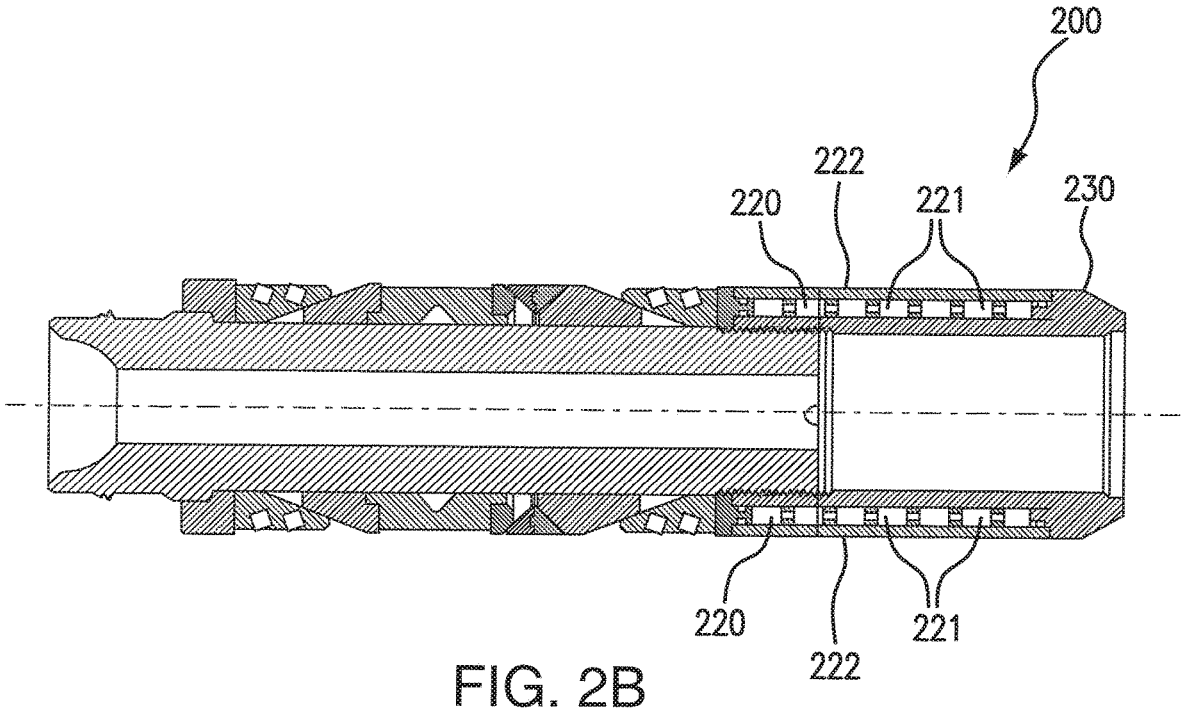
FIG. 2B illustrates a cross-sectional view of a dissolvable frac plug comprising an internal chamber near or at the bottom portion of the plug, according to an embodiment of the principles described herein.

FIG. 2A illustrates a perspective view of a dissolvable frac plug 200, according to another embodiment of the principles described herein. FIG. 2B illustrates a cross-sectional view of the dissolvable frac plug 200, according to an embodiment of the principles described herein. The dissolvable frac plug 200 is substantially similar in many respects to the dissolvable frac plug 100, previously described. For example, the dissolvable frac plug 200 comprises an internal chamber 220. The internal chamber 220 is configured to house a compound that may become corrosive or caustic to the dissolvable portions of the frac plug 200 when mixed with downhole fluids. However, the dissolvable frac plug 200 differs from the dissolvable frac plug 100 principally in the location and structure of the internal chamber 220. The internal chamber 220 of the frac plug 200 shares the same concentric cylindrical outer shape as that of the dissolvable frac plug 100. Unlike the dissolvable frac plug 100, the internal chamber 220 is located near the bottom end of the frac plug 200, and in particular, comprises the bottom cap 230 of the dissolvable frac plug 200. Further, unlike the internal chamber 120 of frac plug 100, the internal chamber 220 comprises a plurality of smaller chambers or sub-chambers 221 arranged in successive hollow rings concentrically formed around the mandrel core. The sub-chambers 221 may have different shapes in other embodiments. The internal chamber 220 comprising sub-chambers 221 is shielded from the well environment by an external wall 222 that is exposed to downhole fluids during the operation of the frac plug 200 and formed with a dissolvable material. The downhole conditions may dissolve the external wall 220 during the operation of the frac plug 200, permitting the compound in the internal chamber 220 to be released into the downhole fluids and form a corrosive solution to degrade the remains of the frac plug 200. Internal walls between the smaller chambers 221 of the internal chamber 220 may also be dissolved during this process, in some embodiments. Also, the different chambers can contain the same compound or different compounds that combine when released to form a more corrosive environment around and adjacent the plug.

Figure 3A:
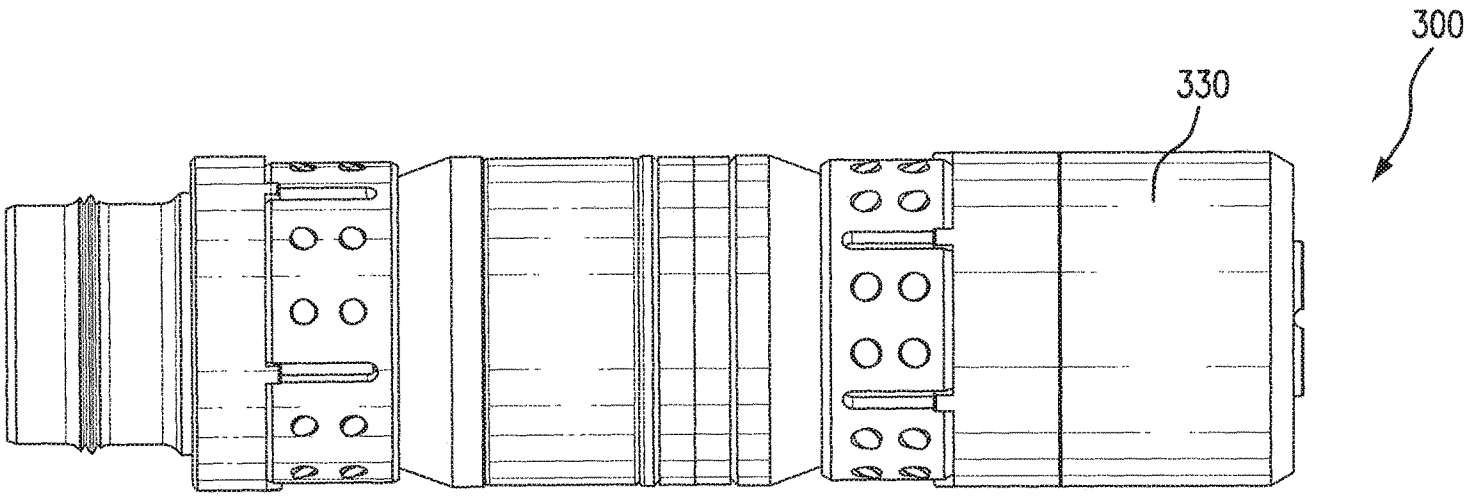
FIG. 3A illustrates a perspective view of a dissolvable frac plug comprising an internal chamber inside a bottom cap of the plug, according to an embodiment consistent with the principles described herein.
Figure 3B:
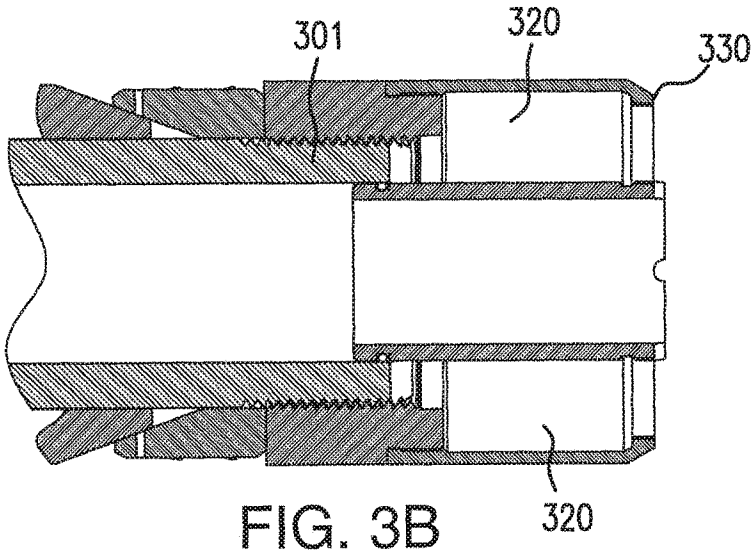
FIG. 3B illustrates a cross-sectional view of a dissolvable frac plug comprising an internal chamber inside a bottom cap of the plug, according to an embodiment consistent with the principles described herein.

FIG. 3A illustrates a perspective view of a dissolvable frac plug 300, according an embodiment of consistent with principles described herein. FIG. 3B illustrates a cross sectional view of the bottom end of the dissolvable frac plug 300 comprising a bottom cap 330, according to an embodiment consistent with the principles herein. The dissolvable frac plug 300 has a generally elongated shape similar to the dissolvable frac plugs 100 and 200, previously described. As with the dissolvable frac plug 200, the internal chamber 320 is located in a bottom cap 330 secured to the bottom end of the frac plug 300. However, in the dissolvable frac plug 300, a single internal chamber 320 is featured in the bottom cap 330, unlike the multiple sub-chambers 221 of the dissolvable frac plug 200. The single internal chamber simplifies and facilitates the manufacture and construction of frac plug 300.

Figure 4A:
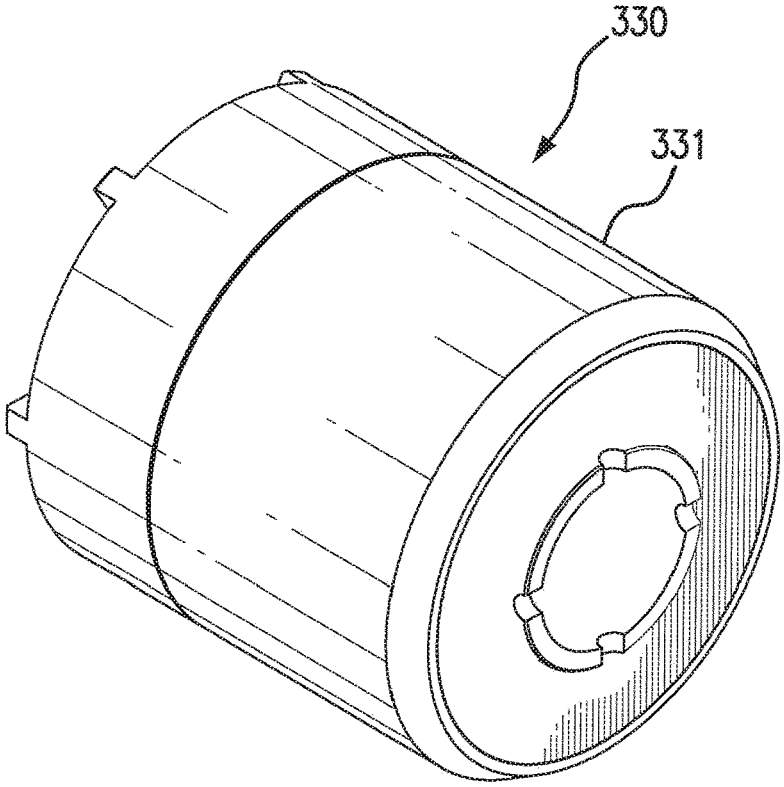
FIG. 4A illustrates a perspective view of a bottom cap of a dissolvable frac plug comprising an internal chamber, according to an embodiment consistent with the principles described herein.
Figure 4B:
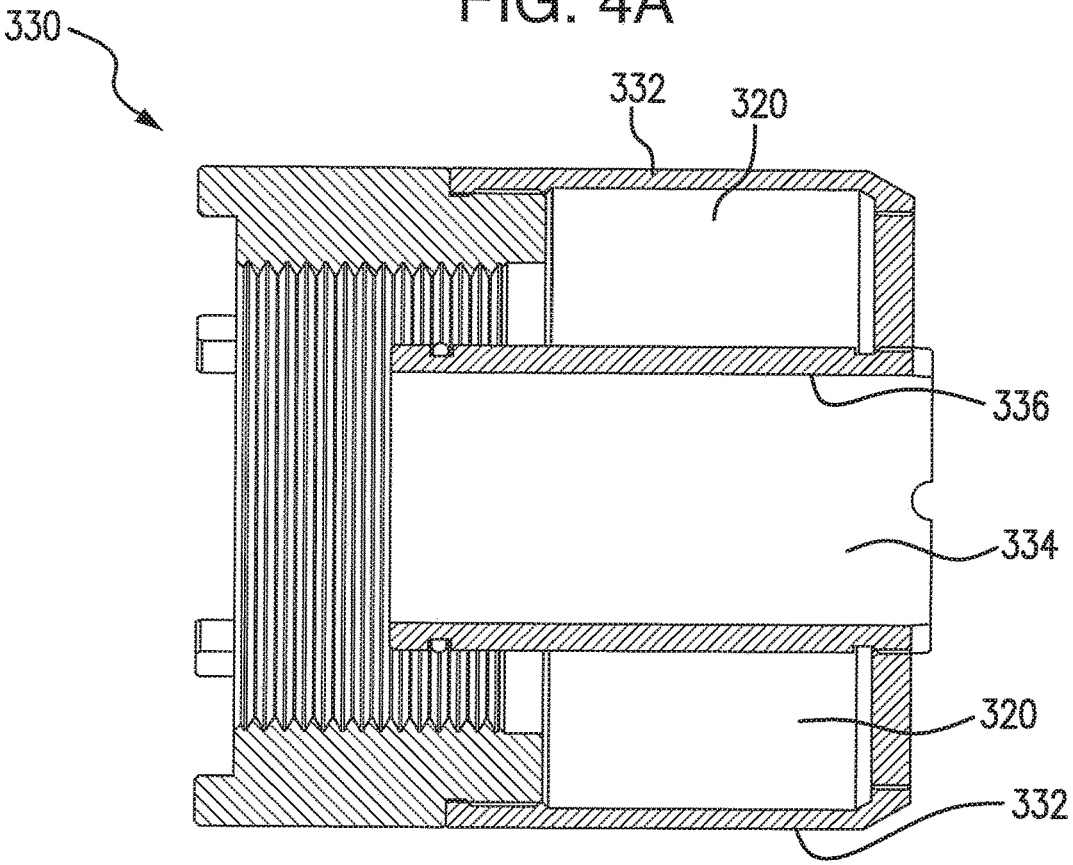
FIG. 4B illustrates a cross-sectional view of a bottom cap of a dissolvable frac plug comprising an internal chamber, according to an embodiment consistent with the principles described herein.

FIG. 4A illustrates a perspective view of a bottom cap 330, according to an embodiment consistent with the principles described herein. FIG. 4B illustrates a cross-sectional view of a bottom cap 330, according to an embodiment consistent with the principles described herein. The bottom cap 330 comprises a cylindrical housing 331 having a threaded inner surface adjacent the upper part of the bottom cap 330. The threaded inner surface of the bottom cap 330 is configured to cooperate with complimentary threads on an outer surface of the mandrel 301 to secure the bottom cap 330 to the mandrel 301. If desired, the threaded disconnect feature on the housing can also be made of dissolvable material. The bottom cap 330 may be attached to the mandrel 301 with other means, in some embodiments. For example, the bottom cap 330 may be welded to the mandrel 301 or integrally formed with it, in some examples. The internal chamber 320 of the bottom cap may have a cylindrical shape that is concentric to a central axis of the bottom cap 330. The internal chamber 320 is separated from the axial bore 334 of the bottom cap 330 by an inner wall 336. An external wall 332 may also separate the internal chamber 320 from the outer surface of the dissolvable frac plug 300 or bottom cap 330, and the downhole environment.

Figure 5A:
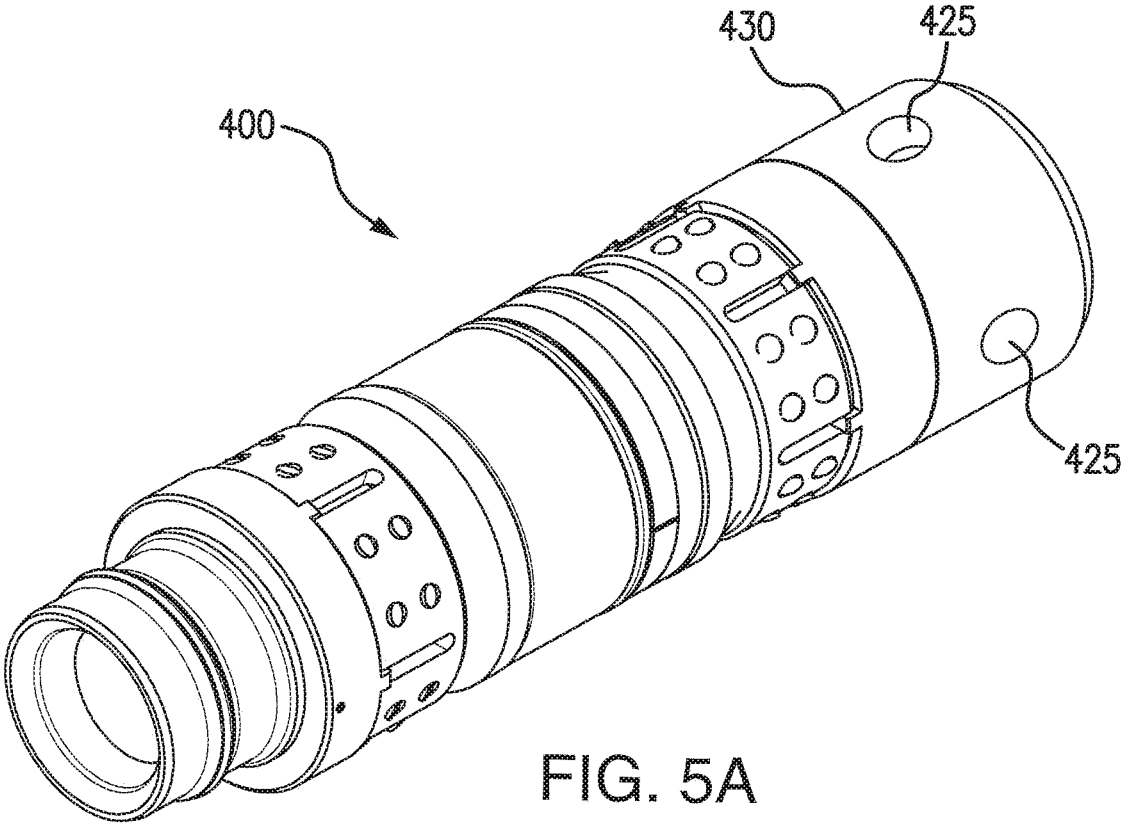
FIG. 5A illustrates a perspective view of a dissolvable frac plug comprising one or more openings in an external wall of the plug, according to an embodiment consistent with the principles described herein.
Figure 5B:
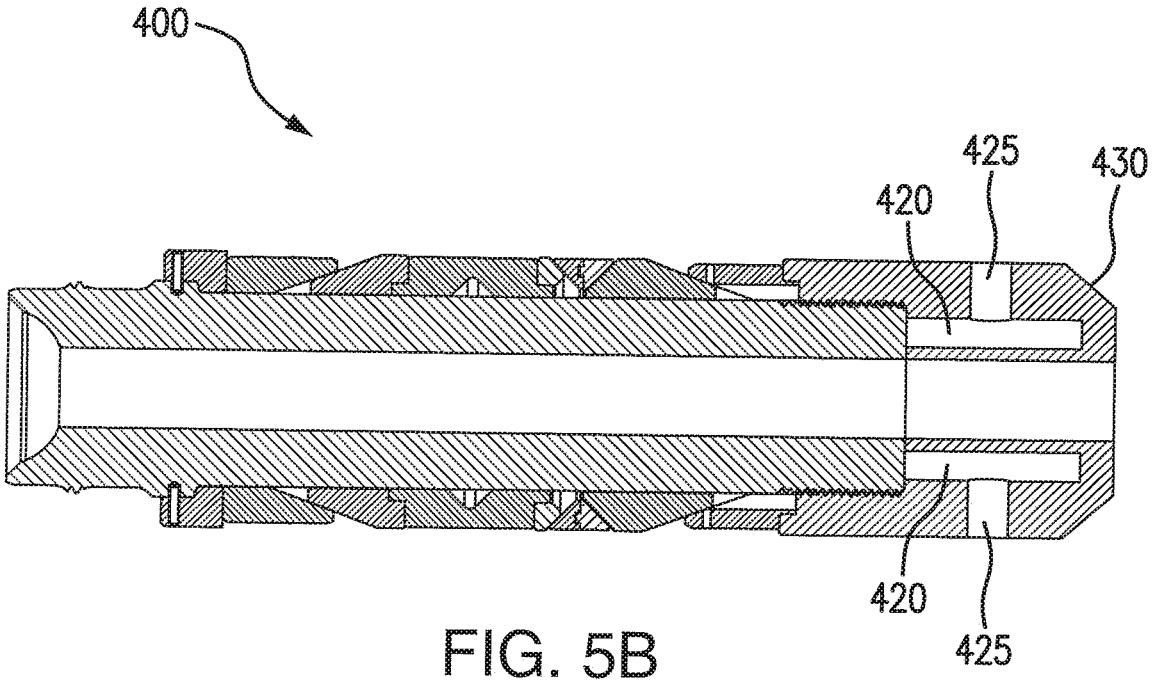
FIG. 5B illustrates a cross-sectional view of a dissolvable frac plug comprising one or more openings in an external wall of the plug, according to an embodiment consistent with the principles described herein.

FIG. 5A illustrates a perspective view of a dissolvable frac plug 400, according an embodiment of consistent with principles described herein. FIG. 5B illustrates a cross sectional view of a dissolvable frac plug 400, according to an embodiment consistent with the principles herein. The dissolvable frac plug 400 has a generally elongated shape similar to the dissolvable frac plugs 100, 200, and 300, previously described. As with the dissolvable frac plugs 200 and 300, the internal chamber 420 is located in a bottom cap 430 secured to the bottom end of the frac plug 400. However, in the dissolvable frac plug 400, an external wall 432 of the dissolvable frac plug 400 includes one or more openings 425 linking the internal chamber 420 to the exterior of the dissolvable frac plug 400.

Figure 6A:
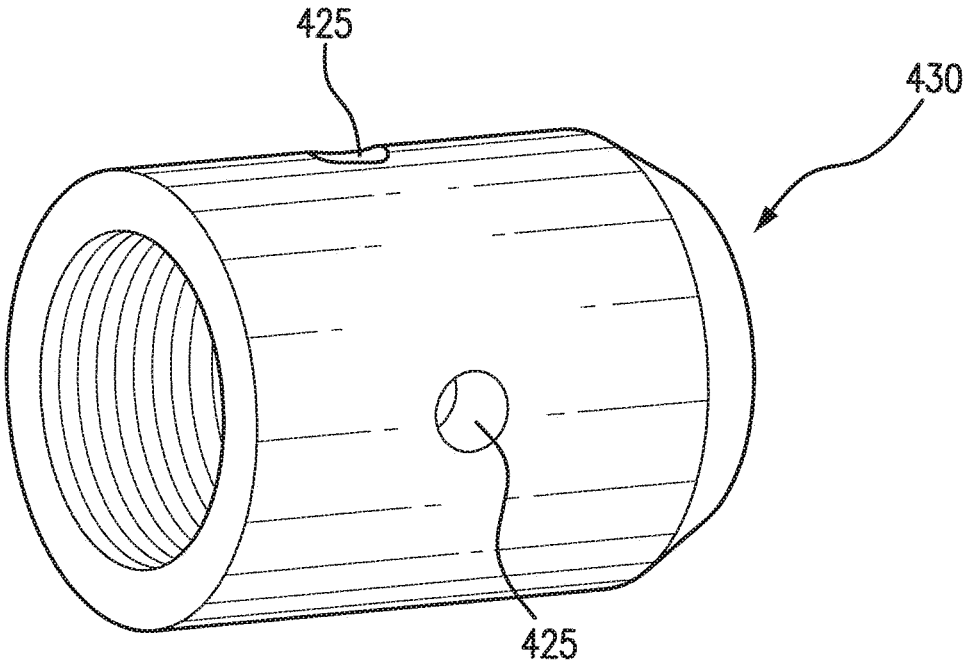
FIG. 6A illustrates a perspective view of a bottom cap of a frac dissolvable plug comprising one or more openings to the internal chamber in the external wall of the bottom cap, according to an embodiment consistent with the principles described herein.
Figure 6B:
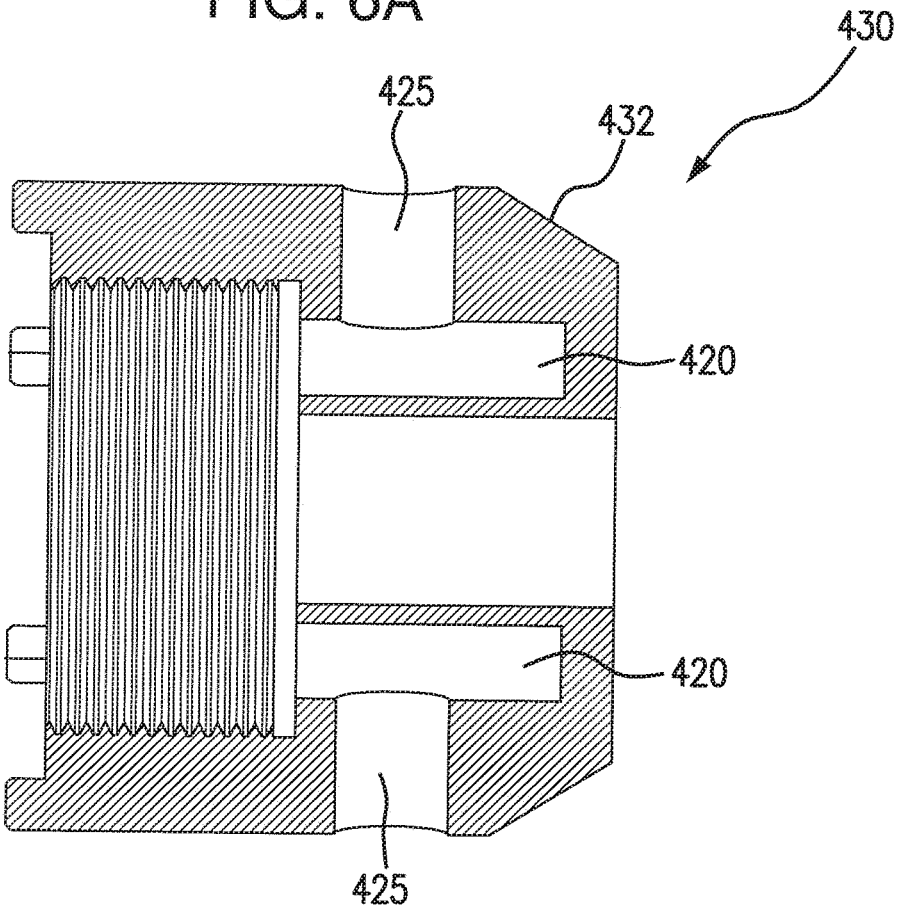
FIG. 6B illustrates a cross-sectional view of a bottom cap of a dissolvable frac plug comprising one or more openings to the internal chamber in the external wall of the bottom cap, according to an embodiment consistent with the principles described herein.

FIG. 6A illustrates a perspective view of a bottom cap 430 having one or more openings 425, according to an embodiment consistent with the principles described herein. FIG. 6B illustrates a cross-sectional view of the bottom cap 430 having one or more openings 425, according to an embodiment consistent with the principles described herein. The bottom cap 430 of the dissolvable frac plug 400 is similar in many respects to the bottom cap 330 of the dissolvable plug 300. In addition, the external wall 432 of the bottom cap 430 may include one or more openings 425 linking the internal chamber 420 to the exterior of the dissolvable frac plug 400. The one or more openings 425 provide access to the internal chamber 420 for filling the chamber with the corrosive material (e.g., sodium bisulfate) before the deployment of the dissolvable frac plug 400. The external wall 432 may comprise any number of openings 425. Further, after the corrosive material is inserted in the internal chamber 420, the openings 425 of the internal chamber 420 may be closed with a curable compound that seals the internal chamber 420 and prevent escape of the corrosive or caustic compound. For example, the openings 425 of the internal chamber 420 may be sealed with epoxy or similar polymer, or any other substance that minimally reacts to the sealed acid and downhole fluids. The openings 425 to the internal chamber 420 are only illustrated in FIGS. 5A-5B and 6A-6B with respect to the internal chamber 420 inside the bottom cap 430 of the dissolvable frac plug 400. However, the internal chambers 120 and 220 of the dissolvable frac plugs 100 and 200 which are located along the mandrels 101 and 201 may also feature similar openings. In some embodiments, these openings in the internal chambers 120 and 220 of the dissolvable frac plugs 100 and 200 may also be sealed with epoxy or similar curable compound to secure the corrosive compound inside.

It should be understood that combinations of described features or steps are contemplated even if they are not described directly together or not in the same context.

It should be understood that claims that include fewer limitations, broader claims, such as claims without requiring a certain feature or process step in the appended claim or in the specification, clarifications to the claim elements, different combinations, and alternative implementations based on the specification, or different uses, are also contemplated by the embodiments of the present invention.

The terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A dissolvable frac plug comprising a mandrel having an axial flowbore running through a central axis of the dissolvable frac plug; a first wall structure forming a first chamber concentric to the mandrel, wherein the first wall structure comprises an external wall portion forming an external wall of the plug; wherein the first chamber contains a material in an amount sufficient to combine with at least one of a chemical compound, water, and a wellbore fluid to form a solution or environment that enhances dissolution of the plug, wherein the external wall portion includes an opening to allow filling or packing of the first chamber with the material and after filling or packing of the first chamber with the material, the opening is filled with a substance that minimally reacts with water and well bore fluids and blocks water and wellbore fluids, and wherein at least a portion of the external wall portion is configured to dissolve, prior to the material combining with the at least one of the chemical compound, the water, and the wellbore fluid, due to contact with at least one of water and a wellbore fluid present on a side of the external wall portion opposite the first chamber.

2. The dissolvable frac plug of claim 1, wherein the external wall portion is made of a magnesium or alloy thereof.

3. The dissolvable frac plug of claim 1 further comprises a second wall structure forming a second chamber, wherein the second chamber comprises the chemical compound.

4. The dissolvable frac plug of claim 1, wherein the material comprises sodium bisulfate, aluminum chloride, or a mixture thereof.

5. The dissolvable frac plug of claim 1, wherein the material is present in the first chamber in an amount that provides a volume ratio of 1.25:1 to 6:1 with respect to a volume of external wall portion.

6. The dissolvable frac plug of claim 1, wherein the external wall portion is configured to dissolve when in contact with water or a wellbore fluid such that, within eight hours to twelve hours, a hole is formed between the chamber and the side of the external wall portion opposite the chamber.

7. The dissolvable frac plug of claim 1, wherein the first chamber comprises a plurality of sub-chambers.

8. The dissolvable frac plug of claim 1, wherein the first chamber is located near or at the upper portion of the plug, near or at the bottom portion of the plug, or inside a bottom cap of the plug.

9. A method of enhancing dissolution of a dissolvable frac plug, which comprises:

providing a dissolvable frac plug comprising a first wall structure forming a first chamber, wherein the first wall structure comprises an external wall portion forming an external wall of the plug, providing the first chamber with a material in an amount sufficient to combine with at least one of a chemical compound, water, and a wellbore fluid to form a solution or environment that enhances dissolution of the plug, wherein the external wall portion includes an opening to allow filling or packing of the first chamber with the material and after filling or packing of the first chamber with the material, the opening is filled with a substance that minimally reacts with water and well bore fluids and blocks water and wellbore fluids, and wherein at least a portion of the external wall portion is configured to dissolve, prior to the material combining with the at least one of the chemical compound, the water, and the well bore fluid, due to contact with at least one of water and a well bore fluid present on a side of the external wall portion opposite the first chamber;

delivering the dissolvable frac plug into a wellbore wherein water or other wellbore fluids are present downstream of the plug.

10. The method of claim 9, wherein the external wall portion is made of a magnesium or alloy thereof.

11. The method of claim 9, wherein the plug further comprises a second wall structure forming a second chamber, wherein the second chamber comprises the chemical compound.

12. The method of claim 9, wherein the material is sodium bisulfate, aluminum chloride, or a mixture thereof.

13. The method of claim 9, wherein the material is present n the first chamber in an amount that provides a volume ratio of 1.25:1 to 6:1 with respect to a volume of the external wall portion.

14. The method of claim 9, wherein the external wall portion is configured to dissolve when in contact with water or a wellbore fluid such that, within eight hours to twelve hours, a hole is formed between the chamber and the side of the external wall portion opposite the chamber.

15. The method of claim 9, wherein the first chamber comprises a plurality of sub-chambers.

16. The method of claim 9, wherein the first chamber is located near or at the upper portion of the plug, near or at the bottom portion of the plug, or inside a bottom cap of the plug.

17. The method of claim 9, wherein the dissolvable frac plug further comprises a mandrel having an axial flowbore running through a central axis of the dissolvable frac plug.

18. The method of claim 17, wherein the first chamber is concentric to the mandrel.

19. A dissolvable frac plug comprising:

a mandrel having an axial flowbore running through a central axis of the dissolvable frac plug;

a first wall structure forming a first chamber concentric to the mandrel, wherein the first wall structure comprises an external wall portion forming an external wall of the plug, wherein the first chamber contains a material in an amount sufficient to combine with at least one of a chemical compound, water, and a wellbore fluid to form a solution or environment that enhances dissolution of the plug, and wherein at least a portion of the external wall portion is configured to dissolve, prior to the material combining with the at least one of the chemical compound, the water, and the wellbore fluid, due to contact with at least one of water and a wellbore fluid present on a side of the external wall portion opposite the first chamber, and a second wall structure forming a second chamber, wherein the second chamber comprises the chemical compound.

* * * * *